United States Patent [19]

Fenton

[11] Patent Number: 4,817,491

[45] Date of Patent: Apr. 4, 1989

[54] APPARATUS FOR A FIREARM AMMUNITION HAND LOADER

[76] Inventor: Arthur Fenton, Box 47, Meteghan, Nova Scotia, Canada, B0W 2J0

[21] Appl. No.: 225,714

[22] Filed: Jul. 28, 1988

[51] Int. Cl.[4] ..... F42B 31/02; F42B 33/02; F42B 11/02

[52] U.S. Cl. ..... 86/19; 74/813 R; 74/817; 86/23; 86/24; 86/27; 86/45

[58] Field of Search ..... 86/19, 23, 24, 25, 27, 86/28, 43, 45; 102/501, 524, 529; 74/813 R, 817; 42/90; 29/1.23, 1.22; 184/14, 26, 27.1, 109

[56] References Cited

U.S. PATENT DOCUMENTS

| | | | |
|---|---|---|---|
| 2,019,795 | 11/1935 | Peterson | 86/19 |
| 2,133,873 | 10/1938 | Sharp | 86/19 |
| 2,403,032 | 7/1946 | Stevens, Jr. | 86/19 |
| 2,535,616 | 12/1950 | Wadman et al. | 86/19 |
| 3,005,372 | 10/1961 | Hall | 86/19 |
| 3,322,020 | 5/1967 | Eckert | 86/19 |
| 3,999,486 | 12/1976 | Bower | 86/19 |
| 4,217,809 | 8/1980 | Hertzler | 86/19 |
| 4,462,298 | 7/1984 | Engles | 86/19 |

FOREIGN PATENT DOCUMENTS

| | | | |
|---|---|---|---|
| 103493 | 3/1938 | Australia | 86/19 |
| 161851 | 3/1915 | Canada . | |

*Primary Examiner*—Howard J. Locker

*Attorney, Agent, or Firm*—Sixbey, Friedman, Leedom & Ferguson

[57] ABSTRACT

An apparatus for a firearm ammunition hand loader. The apparatus provides for the installation of gas checks onto the base of a cast bullet, and sizing and lubricating of the bullet with the gas check on. This is achieved by use of an index table that provides, in a progressive, continuous action, the mounting of the gas check and the sizing and lubrication of the bullet with the gas check mounted thereon, with greater ease and speed than previously known single stage operating devices.

12 Claims, 5 Drawing Sheets

APPARATUS FOR A FIREARM AMMUNITION HAND LOADER

BACKGROUND OF THE INVENTION

The present invention relates to an apparatus for use by a hand loader of ammunition for installing gas checks on bullets and for sizing and lubricating such bullets.

Machines which have been conventionally available for the hand loader of ammunition are of the single stage type for sizing and lubricating of cast bullets. Such devices are mainly fed, by the operator, by hand, one bullet at a time being pressed down into a sizing and lubricating die by a hand operated lever. Gas checks are put on by hand. This is a very slow and not very accurate process.

"Gas checks" are small cups, made from copper, which are of different sizes and diameter depending upon the caliber of bullet used. They are secured onto the base of a lead or lead-alloy cast bullet prior to the sizing and lubricating of that bullet.

Commercial machines are known that do the process of sizing and lubricating. These however are of a mass-production type. They are very expensive and carry out only sizing and lubricating operations.

Prior issued patents describing and illustrating conventional apparatus include U.S. Pat. No. 4,217,809 of Hertzler issued Aug. 19, 1980, which patent describes and illustrates a chain-driven indexing plate for sizing and lubricating bullets simultaneously. Wadman et al U.S. Pat. No. 2,535,616 issued Dec. 26, 1950 describes and illustrates a lever operated bullet lubricator device, and Engles U.S. Pat. No. 4,462,298 issued July 31, 1984 describes and illustrates a plunger-operated bullet sizing device. Bullet sizing and lubricating devices of general background interest are found in U.S. Pat. Nos. 2,019,795 of Peterson issued Nov. 5, 1935, 2,133,873 of Sharp issued Oct. 18, 1938; 2,403,032 of Stevens, Jr. issued July 2, 1946; 3,005,372 of Hall issued Oct. 24, 1961 and 3,322,020 of Eckert issued May 30, 1967. Also of background interest is Canadian Pat. No. 161,851 of Wetherspoon, et al issued May, 1915, which describes and illustrates a bullet swaging machine.

It is an object of the present invention to provide an apparatus designed for the firearm ammunition hand loader which will continuously and accurately permit installation of gas checks on cast bullets and the sizing and lubricating of the bullet with the gas check on. It is a further object of the present invention which will permit such steps to be carried out in a progressive action, with greater ease and speed than has been provided heretofore in apparatus intended for use by ammunition hand loaders.

SUMMARY OF THE INVENTION

The present invention provides an apparatus for use by a hand loader of ammunition, for sequentially installing gas checks on bullets and for sizing and lubricating bullets. The apparatus comprises a frame and a circular index plate rotatable about an axis passing through its center. The plate has associated with it at equally spaced locations about its periphery three bullet receiving slots. Three stations are mounted on the frame and each are positioned to act simultaneously at a different one of the three slots on the index plate. The stations consist of a bullet feed station where bullets, to have gas checks applied and to be sized and lubricated, are supplied to the index plate, a check station where gas checks to be secured to the bullets, are supplied to the index plate and, a size and lubrication station where bullets, with gas checks securely seated thereon, are sized and lubricated. A movable index ratchet is mechanically associated with the index plate which, upon movement, rotates the index plate progressively to align each of the slots with a different one of each of the stations. A handle is associated with the index ratchet to cause movement of the index ratchet and to cause the index plate to move so that its slots are in aligned positions with the stations. A bullet feed means is associated with the bullet feed station to supply individually to an aligned slot at the bullet check station a bullet from a bullet supply reservoir. A gas check supply and seating mechanism is associated with the gas check station to supply individually and in predetermined orientation a gas check from a gas check reservoir to one of the aligned slots in the index plate, and to seat a gas check on the base of the bullet. A slot is provided at the gas check station to receive the gas check from the check supply means, and hold that gas check and a bullet for seating of the gas check on the bullet. A size mechanism is provided comprising a sizing die. A lubricating mechanism is also provided for feeding lubricant from a lubricant reservoir to the sizing die. Both the sizing mechanism and the lubricating mechanism are associated with the size and lube station. A slot is provided in the die for receiving a bullet with a gas check mounted thereon. Bullet guide means cooperate with the index plate to direct bullets being worked on on the index plate from one station to the next. Ejection means are associated with each of the check station and the size and lubrication station to cause bullets in the slots associated with each of those stations to be ejected from those slots when work on the bullet at that station has been completed. An interacting mechanical means, operable by movement of the handle is provided to cause movement of the index ratchet to rotate the index plate so that its slots are properly aligned with each of these stations and to operate the ejection means and perform the necessary work on the bullet at the gas check station and size and lubrication station. A bullet from the bullet reservoir is progressively, sequentially, fed to the index plate, passed to the gas check station where a gas check is securely seated on it, passed to the size and lubrication station where it is sized and lubricated, and then ejected from the index plate.

The present invention provides the hand loader of ammunition with an apparatus that quickly and efficiently installs gas checks on bullets and sizes and lubricates those bullets.

BRIEF DESCRIPTION OF THE DRAWINGS

These and other objects and advantages of the invention will become apparent upon reading the following detailed description and upon referring to the drawings in which.

Figure 1:
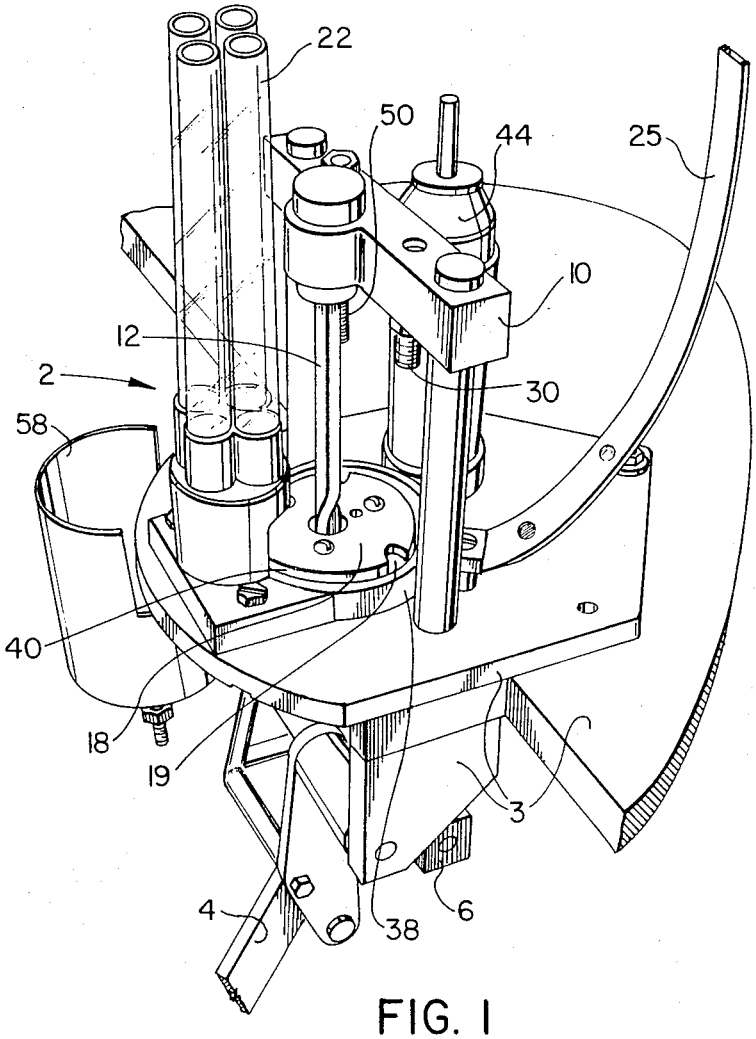
FIG. 1 is a perspective view of an apparatus for installing gas checks and for sizing and lubricating bullets, in accordance with the present invention.

While the invention will be described in conjunction with an example embodiment, it will be understood that it is not intended to limit the invention to such an embodiment. On the contrary, it is intended to cover all alternatives, modifications and equivalents as may be included within the spirit and scope of the invention as defined by the appended claims.

DETAILED DESCRIPTION OF THE INVENTION

In the drawings, similar features have been given similar reference numerals.

Turning to the drawings, there is illustrated in FIG. 1 an apparatus 2 in accordance with the present invention, designed for ammunition hand loading. As will be described in more detail subsequently, this device permits simultaneously, in a progressive action that is continuous, the mounting of gas checks on bullets and the sizing and lubrication of those bullets. A brief description of the various parts of apparatus 2 will be provided, followed by a description how those parts interact to carry out the function of the device.

Apparatus 2 comprises a frame 3 which supports a movable hand lever 4 pivotably secured to frame 3 as illustrated. Frame 3 may be mounted on a workbench by appropriate securing means such as bolts or screws. Hand lever 4 is linked, as illustrated, to lower connecting bar 6 which in turn is connected to rams 8 to which upper connecting bar 10 is mounted. Spiral index shaft 12 is secured to upper connecting bar 10 as illustrated. As will be described in more detail subsequently herein, movement of index shaft 12 rotates index ratchet 14 (FIGS. 5*a* and 5*b*) to cause, in one directional movement, rotative movement about its center of index plate assembly 16 and index plate 18 secured thereto. Slots 19 are provided in the form of notches, at three equally spaced positions in the periphery of plate 18.

Three stations are provided on frame 3, relative to index plate 18. At the first of these stations, the bullet feed station, bullet feed tubes 22 feed bullets t0 index plate 18. In the illustrated embodiment, four bullet feed tubes 22 are provided. Each may be loaded with appropriate numbers of cast bullets. The frame within which the tubes are mounted may be turned about its center so that an appropriate tube is lined up with discharge guide 23, mounted on frame 3 to direct bullets to the appropriate slot 19 in index plate 18, which has been appropriately positioned at this first station. An appropriate detente mechanism, for example a ball and spring detente 24 holds the appropriate tube in alignment with that slot 19 of index plate 18.

At the second of these stations, gas check feed tube 25 feeds gas checks to index plate 18, from a gas check magazine 26. At this station is a gas check guide slot 28 (FIGS. 5*a* and 5*b*) into which a gas check 24 is fed and held in position so that a bullet may be pressed into it by means of gas check top plunger 30 (FIG. 6). An ejector 34 operable upon movement of lower connecting bar 6, ejects the bullet with gas check secured thereon, from guide slot 28. Ejector spring 35 ensures that ejector 34 normally rests in a position not protruding into guide slot 28 so that a new gas check may be fed into slot 28 after a bullet with a gas check mounted thereon has been ejected from that slot. A rubber retainer 36, mounted as illustrated (FIGS. 5*a* and 5*b*) on the inner wall of circular bullet guide 38 prevents that bullet from falling back into guide slot 28 when it has been ejected.

Bullet guide 38 circumscribes and is spaced from the periphery of index plate 18, providing a channel 40 by which, in conjunction with slots 19 in index plate 18, bullets may be moved from one station to the next.

At the third station, sizing and lubricating die 42 (FIG. 6) is mounted on frame 3. A lubricant reservoir or holder 44 is provided with a cavity (not illustrated) through which lubricant may be forced, under pressure from plunger 46 into the aperture of die 42. Screw shaft 48 moves piston 46 to press lubricant through this cavity. Screw shaft 48 is turned by a hand wrench.

Figure 3:
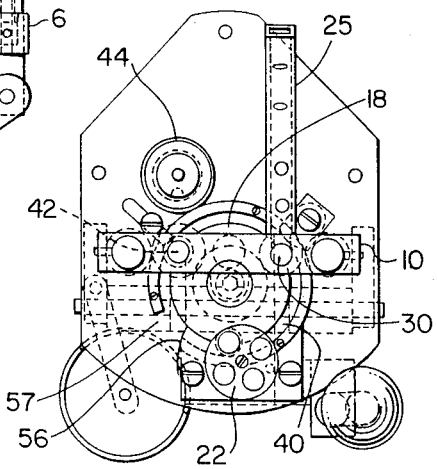
FIG. 3 is a plan view of the device of FIG. 1.

At this third station, lube top plunger 50 (FIG. 6) presses the bullet, with gas check already on the base, which bullet has been received from the second station, into the aperture of die 42, plunger 50 being secured to, and hence movable with, upper connecting bar 10. Bullet sizing ejector 52, the lower end of which extends into cavity 54 in lower connecting bar 6, and the movement of which is thereby controlled by this lower connecting bar, extends with its upper end into the aperture of die 42, when it is in operative position, to eject the sized and lubricated bullet from sizing die 42. An appropriate bullet ejector 56 (FIG. 3), for example an appropriately formed surface extending into channel 40 of bullet guide 38, guides the finished bullet out of channel 40, through opening 57 and into bullet container 58 positioned below the surface of index plate 18, as index plate 18 rotates to its next operative position.

Figure 5A:
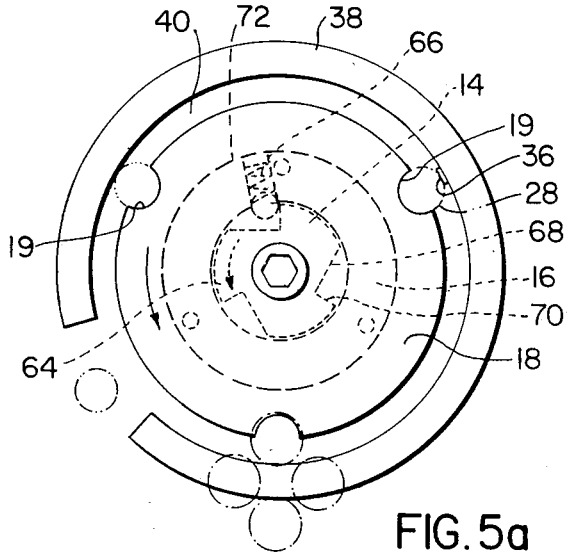
FIGS. 5*a* and 5*b* are schematic detail plan views, of the index plate and bullet guide of the device.
Figure 5B:
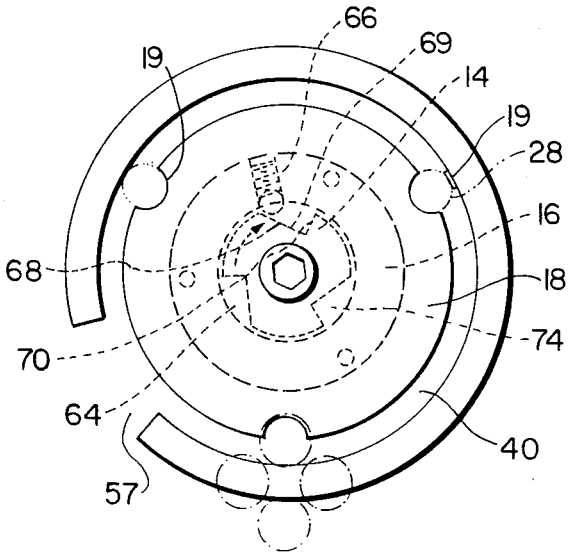
Figure 6:
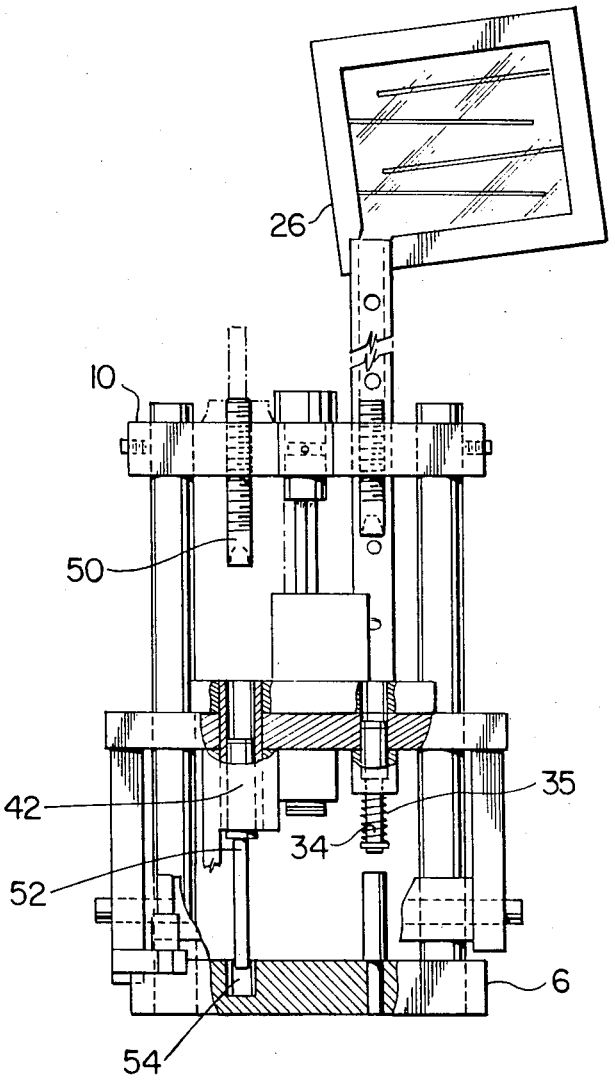
FIG. 6 is a partial front elevation view of the device of FIG. 1.

The index plate assembly 16, and index plate 18 associated with it, is driven by an appropriate drive mechanism 64 (FIGS. 5*a* and 5*b*). Drive mechanism 64 comprises a spring loaded ball 66 and index ratchet 14 positioned within assembly 16. Raising spiral index shaft 12, by raising upper connecting bar 10 to which it is secured, rotates index ratchet 14 120° clockwise. This moves the spring loaded ball back, with the bevelled side 68 of index ratchet 14 (FIG. 5*b*), until the 120° of clockwise rotation is complete. After that, ball 66 is moved back by its spring into the notch 69 of the index ratchet. When spiral index shaft 12 is moved down by upper connecting bar 10, the square edge 70 of notch 69 is now against the ball (FIG. 5*a*) so that index ratchet 14 is prevented from moving in the other direction.

Spring loaded ball 16 is in a bore 72 of larger size than the index ratchet 14 which itself is turning in a cavity 74 in the index plate assembly 16. This causes the ball 66 to drive the index assembly when pushed against by the index ratchet. In this manner the whole index assembly 16 is caused to rotate 120° counterclockwise, following the twist in the spiral index shaft 12.

It will be understood that apparatus 2 has components which may be changed to permit working on a different caliber of bullet. In this regard, the following parts may be made for a specific caliber and bullet shapes:

(a) index plate 18,
(b) gas check guide 28,
(c) gas check ejector 34,
(d) gas check top plunger 30,
(e) bullet lube top plunger 50,
(f) bullet guide 38,
(g) discharge guide 23, and
(h) sizing and lubricating die 42.

OPERATION

The following is a brief description of the operation of apparatus 2 for one rotation of index plate 18.

Prior to operating the device, new cast bullets are put in bullet feed tubes 22 until full and or until desired numbers are put in these tubes. An appropriate one of the feed tubes is aligned with discharge guide 23.

As well, gas checks 24 which will be fed through gas check feed tube 25 to gas check guide slot 28 by gravity feed are loaded into the gas check feed tube 25 with the open cup side of the gas check facing the operator while positioned in front of the machine. They are loaded into tube 25 until that tube is full. They are also loaded into gas check magazine 26, magazine 26 being fitted to the top of gas check feed tube 25 and having a maze of back and forth chambers, as illustrated (FIG. 6), to keep gas checks from becoming jammed where they exit into feed tube 25.

Figure 2:
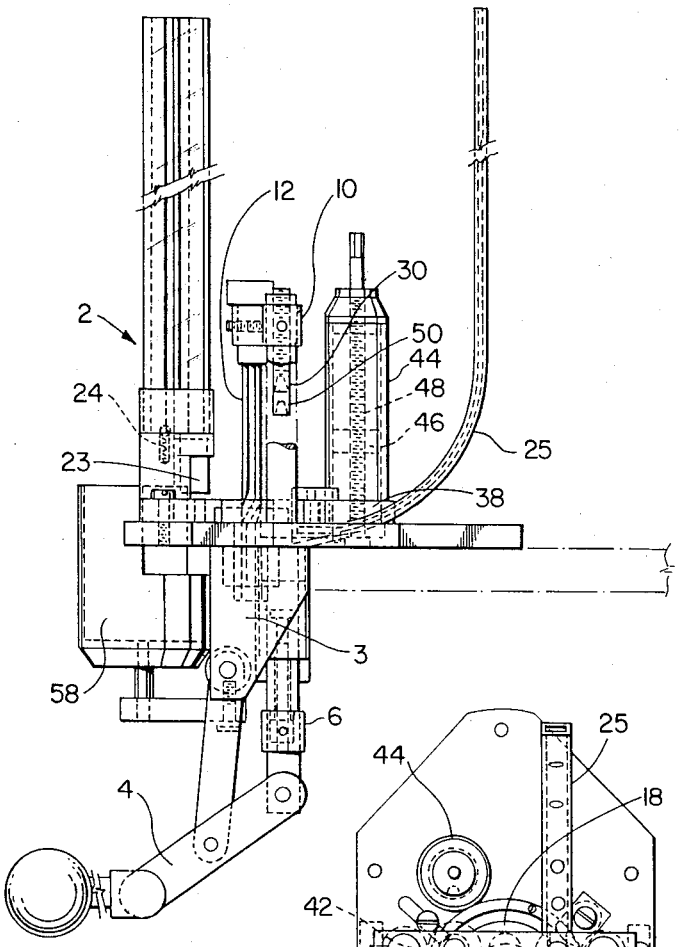
FIG. 2 is an elevation from the right of the device of FIG. 1 with the handle in lowered position.

The action of this machine is started by lowering hand lever 4 (FIG. 2), which in turn raises lower connecting bar 6, rams 8 and upper connecting bar 10. This also raises spiral index shaft 12 which rotates back, clockwise, index ratchet 14 one third of a revolution, or 120°.

Figure 4:
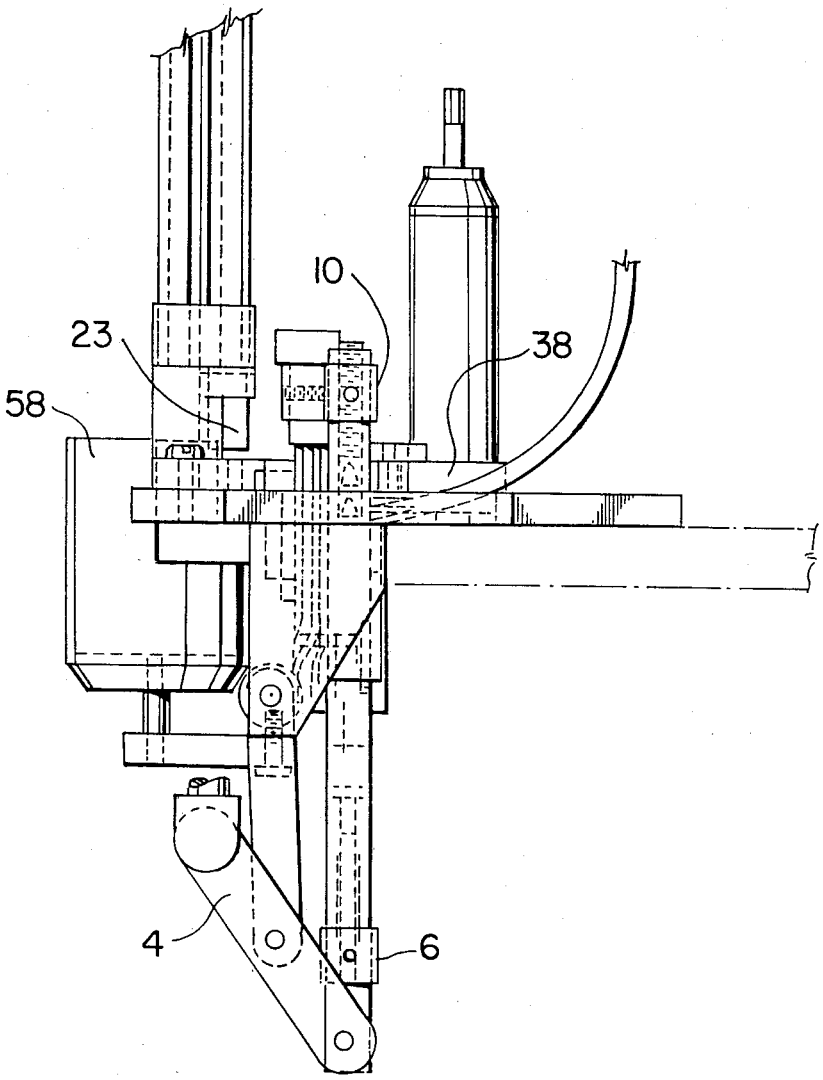
FIG. 4 is an elevation view of the device similar to that of FIG. 2, but with the handle in raised position.

When hand lever 4 is then raised (FIG. 4), it then causes lower connecting bar 6, rams 8, upper connecting bar 10 and spiral index shaft 12 to move downward. At the start of this downward movement of these parts, spiral index shaft 12 causes index assembly 56 to rotate the index plate 18 one third of a revolution, 120° in a counterclockwise direction, advancing a bullet 20 picked up from the bullet feed tube 22 to the first station, to mount a gas check 24. When the index plate 18 stops its 120° rotation, it is held in place by appropriate detente means such as a spring and ball detente (not shown). As the rams 8 continue down, the gas check top plunger 30 then presses the bullet into the gas check guide 28 in which a gas check is held in position after being fed down the gas check feed tube 25, until rams 8 are completely down seating the gas check on the base of the bullet. Upon lowering the hand lever 4 again, the ratchet index 14 again ratchets back, clockwise 120° and lower connecting bar 6 moves ejector 34 up to remove the bullet 20 from the gas check guide slot 28. The bullet, with the gas check on its base, is held up in place by a small rubber retainer 36 mounted in the bullet guide 38. This prevents the bullet from falling back into the gas check guide slot 28, so it may advance to the next stage when the hand lever 4 is again raised.

On raising the hand lever 4 again, the index again engages and advances the index plate 18 120° counterclockwise to the next stage, also picking up another new bullet from the bullet feed tube 22. Now as the rams 8 continue down they press the new bullet into the gas check guide slot 28, which has now picked up a new gas check after the gas check ejector 34 has returned to rest by the ejector spring 35 when the rams 8 start back down. At the same time that the gas check plunger 30 is pressing a new bullet into a new gas check, the lube top plunger 50 is pressing the other bullet, with the gas check alreay on the base, into sizing and lubricating die 42 in the same action. After the hand lever 4 has been raised, completely pressing the bullet with gas check into the sizer and lubricator die 42, and seating the new bullet in the new gas check, the hand lever 4 is then lowered again to eject the new gas check bullet and from the gas check guide slot 28 and the sized and lubricated bullet from the sizing and lubricating die 42 with the aid of the bullet sizing ejector 52 contacting the lower connecting bar cavity 54 and the new gas check and bullet by the gas check ejector 34.

When hand lever 4 has been completely lowered the cycle is then repeated and the hand lever 4 raised again advancing the index plate 18 the last 120°, ejecting the completed bullet that is gas checked, sized and lubricated, out of the index plate 18 by the bullet ejector 56 into the bullet container 58, thus completing the cycle. This process is continued until all bullets in bullet feed tubes 22 are completely emptied out.

The apparatus accordingly quickly and accurately applies checks to bullets and sizes and lubricates bullets, simultaneously at different locations on the index plate 18.

Thus it is apparent that there has been provided in accordance with the present invention an apparatus for a firearm ammunition hand loader that fully satisfies the objects, aims and advantages set forth above. While the invention has been described in conjunction with a specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What I claim as my invention:

1. An apparatus for use by a hand loader of ammunition, for installing gas checks on bullets and for sizing and lubricating bullets, the apparatus comprising:

(a) a frame;

(b) a circular index plate rotatable about an axis passing through its center, the plate having associated with it at equally spaced locations about its periphery three bullet receiving slots;

(c) three stations mounted on the frame and each positioned to act simultaneously at a different one of the three slots on the index plate, the stations consisting of:

(i) a bullet feed station where bullets, to have gas checks applied and to be sized and lubricated, are supplied to the index plate, (ii) a check station where gas checks to be secured to the bullets, are supplied to the index plate and, (iii) a size and lubrication station where bullets, with gas checks securely seated thereon, are sized and lubricated;

(d) movable index ratchet means mechanically associated with the index plate which, upon movement, rotates the index plate progressively to align each of the slots with a different one of each of the stations;

(e) handle means associated with the index ratchet means to cause movement of the index ratchet means and to cause the index plate to move so that its slots are in aligned positions with the stations;

(f) a bullet feed means associated with the bullet feed station to supply individually to an aligned slot at the bullet check station a bullet from a bullet supply reservoir;

(g) a gas check supply and seating mechanism associated with the gas check station to supply individually and in predetermined orientation a gas check from a gas check reservoir to one of the aligned slots in the index plate, and to seat a gas check on the base of the bullet, a slot being provided at the gas check station to receive the gas check from the check supply means, and hold that gas check and a bullet for seating of the gas check on the bullet;

(h) a size mechanism comprising a sizing die;

(i) a lubricating mechanism for feeding lubricant from a lubricant reservoir to the sizing die, both the sizing mechanism and the lubricating mechanism associated with the size and lubricating station, a slot in the die for receiving a bullet with a gas check mounted thereon;

(j) bullet guide means cooperating with the index plate to direct bullets being worked on on the index plate from one station to the next;

(k) ejection means associated with the check station and the size and lubrication station to cause bullets in the slots associated with each of those stations to be ejected from those slots when that station's work on the bullet has been completed; and (l) interacting mechanical means, operable by movement of the handle means, to cause movement of the index ratchet means to rotate the index plate so that its slots are properly aligned with each of these stations and to operate the ejection means and perform the necessary work on the bullet at the gas check station and size and lubrication station, whereby a bullet from the bullet reservoir is progressively, in sequence, fed to the index plate, passed to the gas check station where a gas check is securely seated on it, passed to the size and lubrication station where it is sized and lubricated, and then ejected from the index plate.

2. An apparatus according to claim 1 wherein a plunger, mechanically associated with the interacting mechanical means, is associated with the gas check station to apply pressure to seat a check on a bullet positioned in the slot of that station, to securely seat the gas check on that bullet.

3. An apparatus according to claim 1 wherein a plunger, mechanically associated with the interacting mechanical means, is associated with the sizing and lubrication station to apply pressure to a bullet positioned in the slot of the die at that station, to apply pressure to size the bullet in that die at that station.

4. An apparatus according to claim 2 wherein a plunger, mechanically associated with the interacting mechanical means, is associated with the sizing and lubrication station to apply pressure to a bullet positioned in the slot of the die at that station, to apply pressure to size the bullet in that die at that station.

5. An apparatus according to claim 1 wherein the index ratchet means comprises a ratchet associated with the interacting mechanical means to rotate the index plate 120° on movement of the handle means a predetermined amount in one direction and to hold the index plate in position without rotation upon movement of the handle means in the other direction.

6. An apparatus according to claim 4 wherein the index ratchet means comprises a ratchet associated with the interacting mechanical means to rotate the index plate 120° on movement of the handle means a predetermined amount in one direction and to hold the index plate in position without rotation upon movement of the handle means in the other direction.

7. An apparatus according to claim 1 wherein the bullet guide means comprises a circular shoulder extending about the periphery of the index plate, the bullet receiving slots in the index plate being located on the periphery of the index plate, so that bullets are carried by the slots in the index plate from one station to the next and guided in this movement by the shoulder.

8. An apparatus according to claim 6 wherein the bullet guide means comprises a circular shoulder extending about the periphery of the index plate, the bullet receiving slots in the index plate being located on the periphery of the index plate, that bullets are carried by the slots in the index plate so from one station to the next and guided in this movement by the shoulder.

9. An apparatus according to claim 1 wherein the bullet reservoir comprises bullet feed tube means aligned with the bullet feed station.

10. An apparatus according to claim 1 wherein a gas check feed tube means is provided to feed, by gravity, gas checks from the gas check reservoir to the slot at the gas check station, the feed tube means being of a size and construction to permit gas checks to leave the tube and be fed to the slot at the gas check station one at a time.

11. An apparatus according to claim 1 wherein pressure means are provided in the lubrication reservoir to feed lubricant through a cavity to the sizing and lubricating die.

12. An apparatus according to claim 4 wherein the interacting mechanical means comprises a plurality of bar means mechanically associated with the handle means and movably associated with the frame, the rams and the ejector means being associated with these bars.

* * * * *